US005752600A

United States Patent [19]

Kurashina et al.

[11] Patent Number: 5,752,600

[45] Date of Patent: May 19, 1998

[54] WATCH PACKAGE AND DISPLAY STAND

[75] Inventors: Shigeho Kurashina; Keiji Ikeda, both of Tokyo, Japan

[73] Assignee: Seiko Kabushiki Kaisha Hattori Seiko, Tokyo, Japan

[21] Appl. No.: 645,469

[22] Filed: May 13, 1996

[51] Int. Cl.[6] ..... B65D 85/40

[52] U.S. Cl. ..... 206/301; 206/459.5; 206/764

[58] Field of Search ..... 206/301, 216, 206/459.5, 758, 764, 765, 493

[56] References Cited

U.S. PATENT DOCUMENTS

| | | |
|---|---|---|
| 312,421 | 2/1885 | Bauer . |
| 995,259 | 6/1911 | Kingsbury . |
| 1,848,764 | 3/1932 | Beyer . |
| 2,022,906 | 12/1935 | Weeks . |
| 3,872,966 | 3/1975 | Gordon et al. . |
| 4,082,183 | 4/1978 | Sturm . |

FOREIGN PATENT DOCUMENTS

| | | |
|---|---|---|
| 3-162241 | 7/1991 | Japan . |

*Primary Examiner*—Paul T. Sewell
*Assistant Examiner*—Nhan T. Lam
*Attorney, Agent, or Firm*—Stroock & Stroock & Lavan LLP

[57] ABSTRACT

A package for shipping and permitting display of an article, such as a wristwatch, is provided. The package is constructed with a box without a bottom and having a cutout on one side and a sleeve to display price or other indicia on two different places on a display for the watch stored within the box. A C-shaped cuff member is provided having a stopper for holding a watch thereon without it sliding during transportation. The C-shaped cuff member is also designed for holding watches having bands of different lengths.

4 Claims, 6 Drawing Sheets

WATCH PACKAGE AND DISPLAY STAND

BACKGROUND OF THE INVENTION

The present invention relates to a package for shipping and permitting display of indicia associated with a product in the package, and in particular to, a watch package constructed with a box without a bottom and having a cut out on one side and a sleeve to display price or other indicia at two different places on a display for the watch stored within the box.

There are numerous patents in the prior art dealing with displaying information within the contents of the box. For example, U.S. Pat. No. 312,421 to Bauer discloses a box with cutouts on the bottom and side thereof to display the contents of the box, in this case, eggs. Although a plurality of cut-outs are disclosed, one cut-out is associated with one item stored within the box. U.S. Pat. No. 995,259 to Kingsbury discloses a box cover including cut-outs positioned on opposite ends of the box for displaying indicia on an insert or tray for the box. The cut-outs, however, do not expose for viewing the products stored within the box. U.S. Pat. No. 1,848,764 to Beyer discloses a box with cut-outs on one side for displaying different pieces of indicia on tickets contained within the box. The cut-outs display two different sources of information on one side of a single one of a plurality of products stored in the box, not two sources of information on two different sides of a single product.

U.S. Pat. No. 2,022,906 to Weeks discloses a box with cut-outs on different, adjacent sides of the box. However, the two cut-outs do not correspond to indicia on a single item. The carton is for holding letters for delivery to the post office. The first opening discloses an address, while the second opening reveals an edge of the letters to permit counting of the number of letters therein. U.S. Pat. No. 3,872,966 to Gordon et al. discloses a box having two cut-outs for displaying price indicia on individual packages contained within the box. Although two cutouts are disclosed on the box, the two cut-outs do not correspond to indicia on a single item. Rather, each carton holds six packages with the end of three exposed in each opening. Japanese Application No. 3-162241 discloses a box having a cut-out for displaying bar code information or the like on a flap extending into the box for an end panel.

In addition, there are numerous boxes within the trade that use various methods for displaying information contained on the product. Two examples are those used by WalMart and Timex to ship and display watches. In particular, WalMart requires many of its watch suppliers to use a package which consists of a rectangular box having a window on the bottom. Packaged within the box is a watch stand having a C-shaped member supported on a rectangular base. A wall running from the front to rear of the base creates a compartment for receiving a warranty and instruction material that is wedged into the space. The bottom of that wall is exposed to a window and bears a bar code, an SKU number and manufacturer ID number.

Similarly, Timex uses a box which includes two cut-outs or windows. The first cut-out is on the bottom of the box, off-set towards the back and left side and is essentially rectangular in shape. The bar code indicia identifies the watch mounted on the stand. A second cut-out is positioned on the bottom of the back panel of the box and is used to display price indicia. The second cut-out is rectangular in shape with one comer thereof inclined to mimic the inclined front top comer of the base of the display stored within the box. The bar code on the bottom of the Timex display visible through the bottom cut-out permits inventory control and may be used in conjunction with an automatic labeling machine which reads the bar code, creates a customized price label and affixes the price label through the second cut-out.

Accordingly, it is desired to provide an improved watch package which enables simple labeling and bar coding information to be placed on two places of a display within the box to be read without taking the box apart during the process.

With respect to C-shaped cuffs for holding watches on the display, these are also well-known in the art. For example, U.S. Pat. No. 4,082,183 to Sturm discloses a watch display having a curved or C-shaped portion which extends upward from a base for holding a watch. Many of the shaped cuffs presently in the marketplace have tabs on the side edges thereof for holding the band in place. However, none of these cuffs have any means for holding the face of the watch in position for display. Further, there is no method or means for having the C-shaped cuff holding watches having bands of different lengths. Rather, the different size C-shaped cuffs are produced to hold different sized watch bands.

Accordingly, it is desired to provide a C-shaped cuff for holding the watch face in position and to hold watches having bands of different lengths.

SUMMARY OF THE INVENTION

Generally speaking, in accordance with the invention a package for shipping and permitting display of an article such as a wristwatch is provided. The package includes a stand for holding and displaying the article. The stand includes a base having at least two surfaces for receiving labels bearing information associated with the article. The carton includes a first panel, a second panel opposite the first panel, a first end panel between the first and second panels, a pair of side panels substantially perpendicular to the end panel and between the first and second panels and an open end opposite the first end. At least one of the panels has a carton opening. A sleeve is also provided having a first side, a second side opposite the first side, a first end between said first and second sides, and a second end opposite said first end. A pair of open ends are substantially perpendicular to the first and second ends and between the first and second sides. At least one of the sides includes a sleeve opening. The stand is inserted through the opening of the carton so that the stand is substantially covered by the carton to form a partial package. The partial package is then inserted into one of the open ends of the sleeves to form an assembled package so that the sleeve opening and the carton opening each expose one of the two regions of the base of the stand.

A display device is also provided for a wristwatch having a band and a watch face capable of being free standing on a support surface. The display device includes a base having a first side, a second side opposite the first side, a first end between the first and second sides and a second end opposite the first end. The first end of the base rests on the support surface. A connecting member is provided and extends from the second end of the base. A generally C-shaped cuff having an inner and outer circumference is coupled to the connecting member. The wristwatch extends around the outer circumference of the cuff member with the watch face being generally positioned on the cuff member opposite the opening of the cuff member. A stopper is positioned on the cuff member below the watch face so that the watch is prevented from movement.

A second display device is provided for a wristwatch having a band and watch face capable of being free standing on a support surface. The display device also includes a base having a first side, a second side opposite the first side, a first end between the first and second sides and a second end opposite the first end. The first end of the base rests on the support surface. A connecting member extends from the second end of the base. A generally C-shaped cuff member having an inner and outer circumference is coupled to the connecting member. A guide member is coupled to the cuff member near the opening of the cuff member. The guide member extends substantially away from the outer circumference of the cuff member. The wristwatch extends around the outer circumference of the cuff member and the guide member. The watch face is generally positioned on the cuff member opposite the opening of the cuff member.

Accordingly, it is an object of the invention to provide an improved watch package for displaying information such as price and bar code.

It is another object of the invention to provide a watch package which can easily be used in conjunction with a bar code and tagging machine without taking the box apart to label the item contained therein.

It is still another object of the invention to provide a C-shaped cuff for a watch stand which is capable of holding watches of a variety of band lengths.

It is yet another object of the invention to provide a C-shaped cuff which prevents the watch face from slipping down during transport and display.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
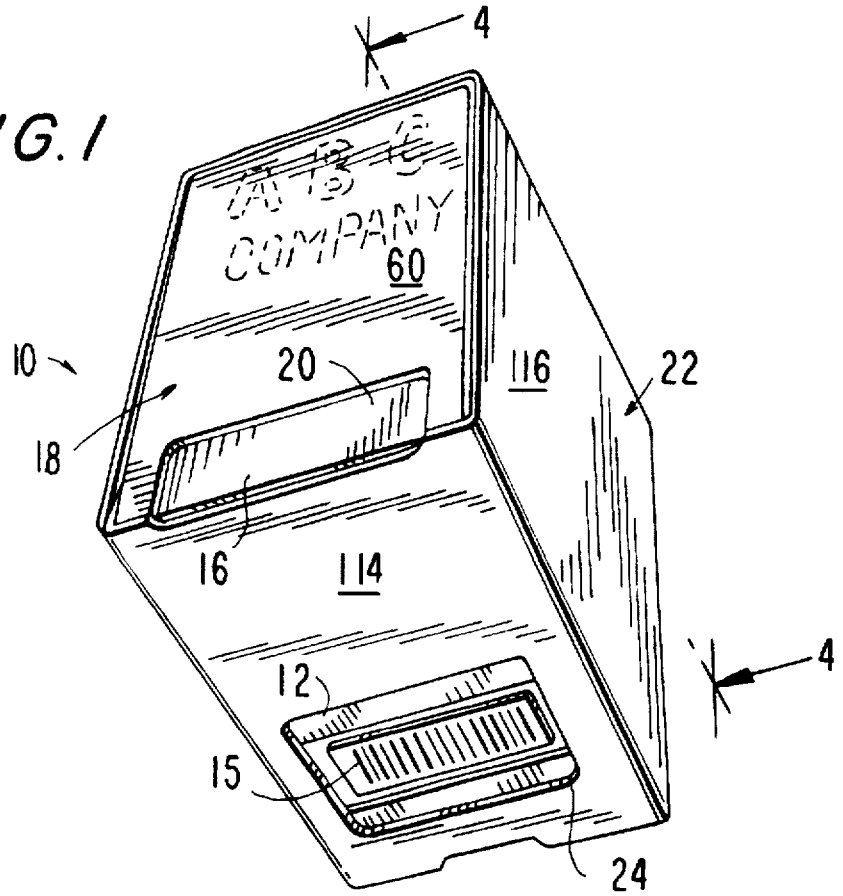
FIG. 1 is a perspective view of the assembled package constructed in accordance with the present invention.
Figure 3:
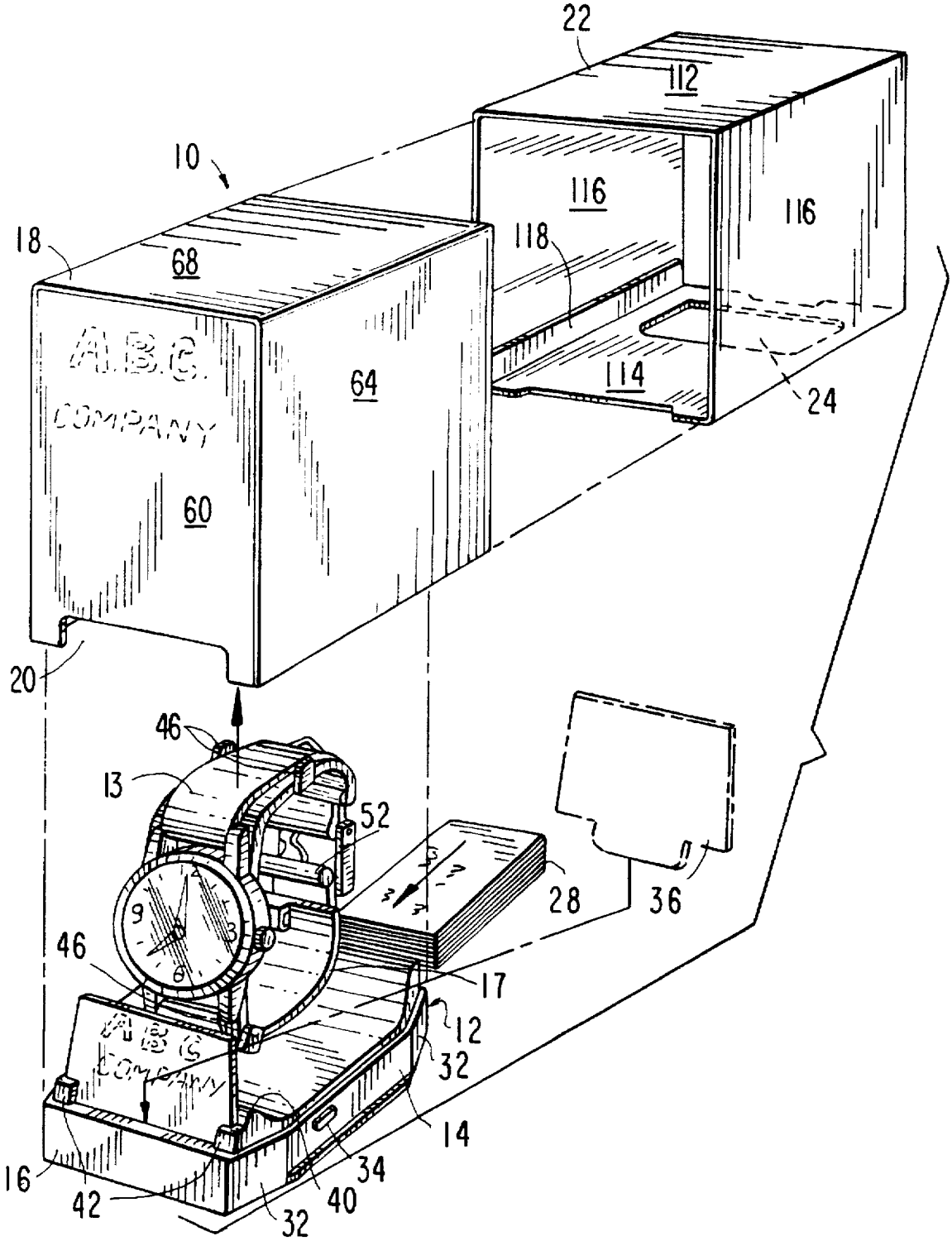
FIG. 3 is an exploded perspective view of the watch package of FIG. 1.

Referring specifically to FIGS. 1 and 3, a watch package, generally indicated as 10, constructed in accordance with the present invention is depicted. FIG. 1 discloses package 10 in an assembled condition, while FIG. 3 discloses a watch package in an exploded view showing how package 10 is assembled. The watch package consists of three basic elements; a watch stand 12, a box 18, and a sleeve 22. Each element will be described separately and the interaction and assembly of the three components will thereafter be described.

Figure 5:
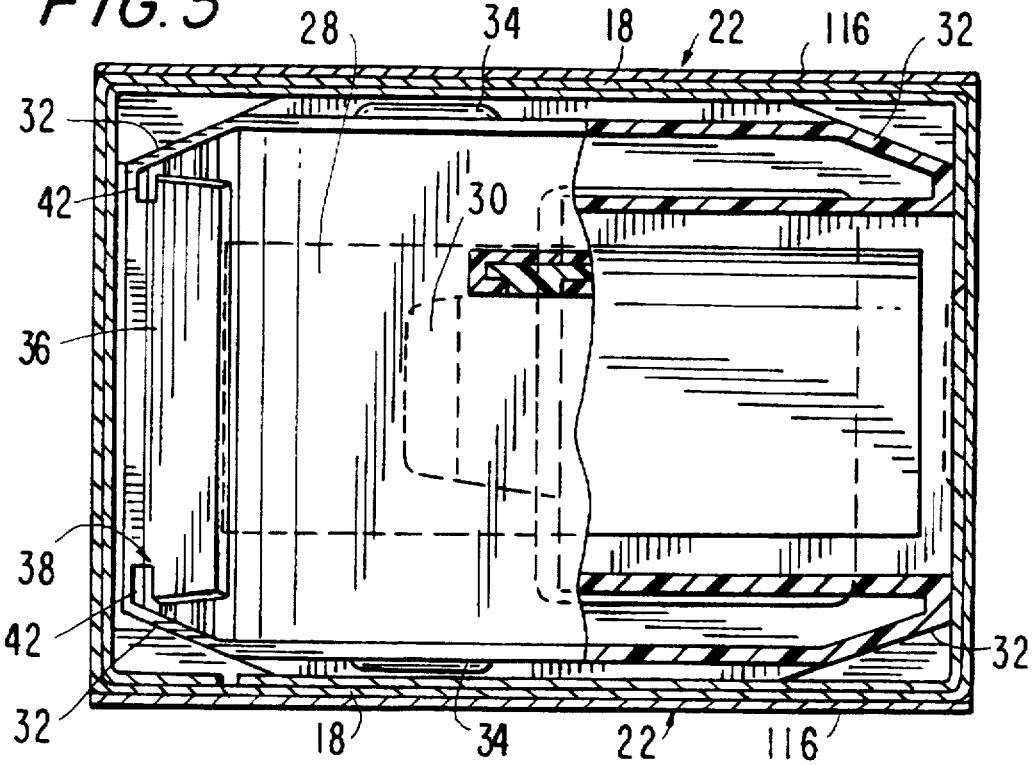
FIG. 5 is a cross-sectional view taken along line 5—5 of FIG. 4.
Figure 4:
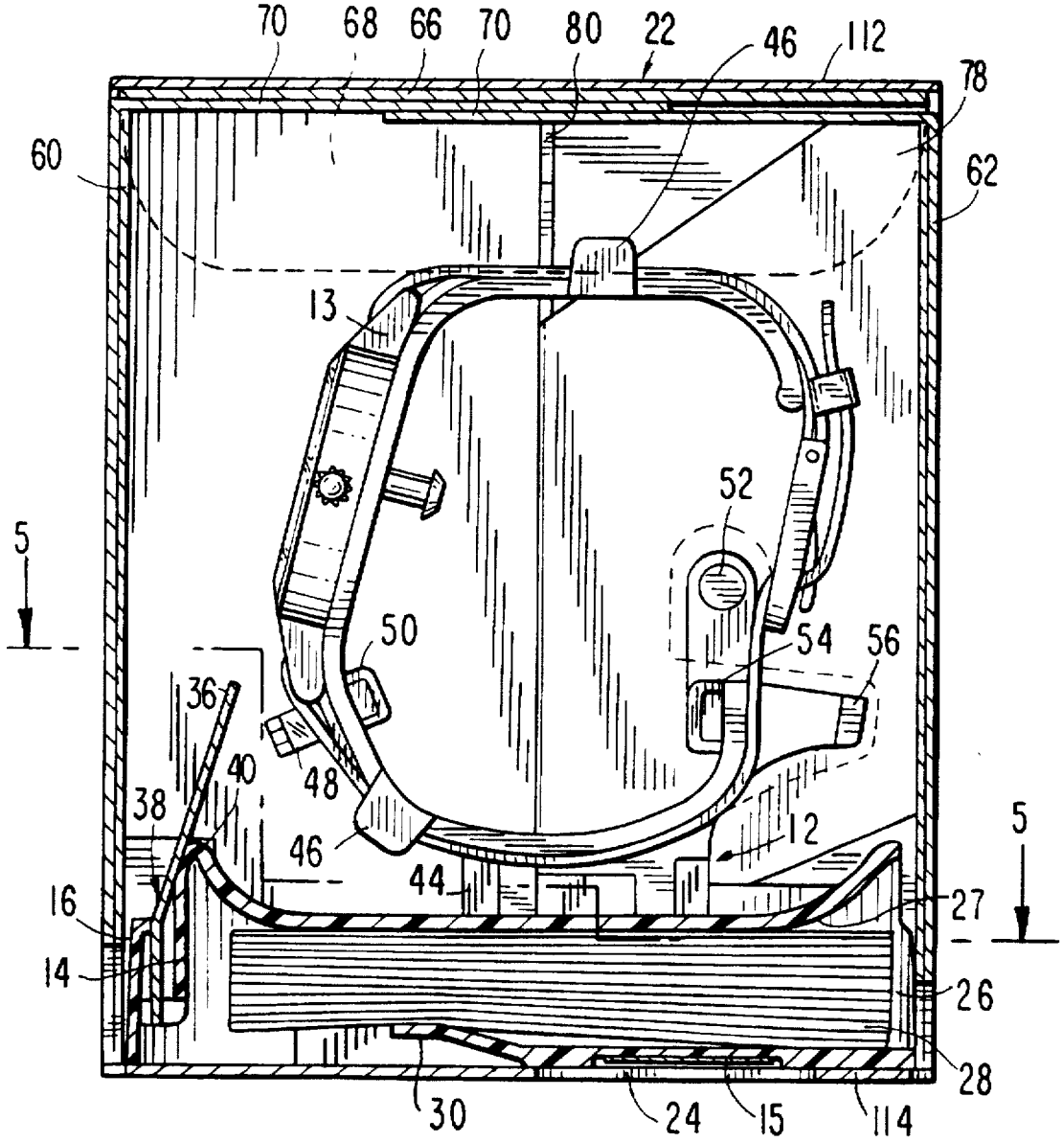
FIG. 4 is an enlarged cross-sectional view taken along line 4—4 of FIG. 1.

First, a watch stand 12 as shown in FIGS. 3–5, for holding a watch 13 includes a base 14. On the bottom side of base 14 is a bar code label receiving surface 15 for receiving a bar code label thereon. Base 14 includes a face 16 which extends essentially perpendicular to bar code label 15. Face 16 is used for the placement of other sales indicia such as product name, price or the like. A C-shaped cuff 17 is positioned atop base 14. Watch 13 is mounted on C-shaped cuff 17. Sleeve 22 includes a cut-out 24 for disclosing bar code label 15 on the bottom of base 14 of stand 12.

Base 14 of stand 12 includes an opening 26 on the end of base 14 opposite face 16 into a cavity 27 for receiving instructions, manuals, warranty cards 28 or the like. A flexible tab 30 formed on base 14 extend into cavity 27 and holds manuals 28 in position within base 14. The two ends, that is the ends defined by face 16 and opening 26, include indents 32, which narrow towards the center so as to facilitate insertion of stand 12 into box 18. On each side of base 14 is a locking tab 34 for interaction with the interior of box 18. Again, this feature will be described in greater detail below.

A tag 36, manufactured from paper or the like, is typically provided to disclose the product features of the watch being sold. Tag 36 is inserted into tag receiving assembly 38 formed on base 14. Tag receiving assembly 38 includes a back support 40 and two front supports 42 spaced from back support 40 which serve to both hold tag 36 in position therebetween and insure that tag 36 remains upright for easy viewing to the consumer when stand 12 is removed from box 18 for display in a sales counter.

Figure 8:
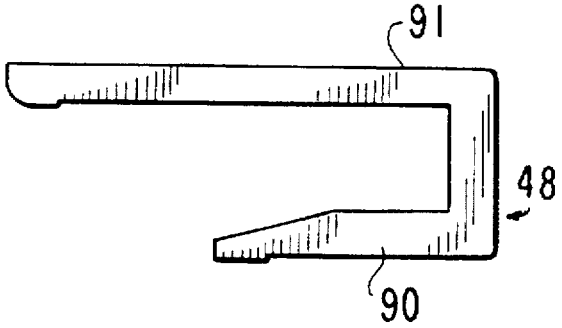
FIG. 8 is an enlarged plan view of the stopper constructed in accordance with the invention.

C-shaped cuff 17 is connected to base 14 via connecting member 44. C-shaped cuff 17 includes a plurality of guide tabs 46 and, in the preferred embodiment, includes three guide tabs 46 extending along the outer edges of C-shaped cuff 17 to hold the watch band in place during display. A removable stopper 48 for preventing watch 13 from sliding along C-shaped cuff 17 is mounted on the lower front end of stand 12 along C-shaped cuff 17. Stopper 48 is an essentially U-shaped member (FIG. 8) with one arm 90 being inserted into a holder 50 in the interior of C-shaped cuff 17, while the other arm 91 of stopper 48 is positioned on the exterior of C-shaped cuff 17.

The interior portion of the U-shaped member of stopper 48 is configured so that a watch band may be inserted between arm 91 of stopper 48 and C-shaped cuff 17. In this manner, because stopper 48 extends across the width of C-shaped cuff 17 holds the watch face in the desired position on C-shaped cuff 17, especially watches with metal bands. In a preferred embodiment, stopper 48 is positioned on C-shaped cuff 17 so that it is hidden by tag 36 when the consumer views the display stand from the front. Prior to this construction, watch bands would slide on C-shaped cuff 17 during transportation so that when a sales keeper opens the box, he or she needed to readjust the watch on the stand. However, by means of stopper 48, the watch face remains in place during shipping as well as display.

Figure 7:
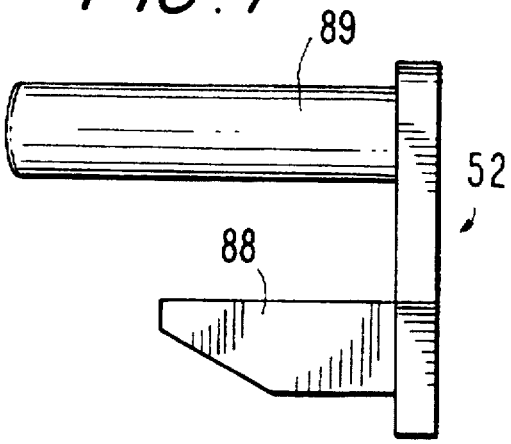
FIG. 7 is an enlarged plan view of the cuff extendor constructed in accordance with the invention.

A cuff extender 52, also U-shaped having a first arm 88 and a second arm 89 (FIG. 7), is provided to enable larger watch bands to be mounted on a single sized C-shaped cuff 17. A holder 54 is formed on C-shaped cuff. Arm 88 of cuff extender 52 is inserted into holder 54. Upon insertion of arm 88 into holder 54, second arm 89 of cuff extender 52 becomes positioned essentially between the two free ends of C-shaped cuff 17. In a preferred embodiment, first arm 88 and holder 54 are each shaped to prevent rotation relative to each other after insertion, while second arm 89 is preferably rounded or smooth to facilitate sliding watch 13 thereon. The operation of cuff extender 52 will be described below in greater detail. In addition, a guide member 56 extends from C-shaped cuff 17 to guide the band of watch 13 around C-shaped cuff 17. Stand 12 is configured and arranged to receive watches having different band lengths. Based on this construction, there are many ways to position a watch on C-shaped cuff 17.

A watch with a short band (i.e. small size), such as those made with leather, vinyl or rubber, will travel through a path around C-shaped cuff 17 so that the band is essentially positioned around the outer circumference of C-shaped cuff 17 and within the gap formed between C-shaped cuff 17 and guide member 56 as shown in solid lines in FIG. 4. A watch with a slightly longer band (i.e. medium size), such as those made with metal bracelets, will be extended around the outer circumference of C-shaped cuff 17 and around the outer portion of guide member 56. In other words, the band will not rest between C-shaped cuff 17 and guide member 56, but rather the band will be placed on the outside of guide member 56. For watches having even longer bands (i.e. large size), cuff extender 52 will be used. More specifically, the band will be positioned about C-shaped cuff 17 and guide member 56 in the manner described above with respect of the medium sized band. The band will then be folded so that it extends around cuff extender 52 shortening the effective length of the band. In this manner, the band will surround the other portion of guide member 56, fold towards the interior of C-shaped cuff 17 and then rest between cuff extender 52 shown and each free end of C-shaped cuff 17. The path of the larger size band is shown in dashed lines in FIG. 4. Accordingly, a single stand is now created that can handle watches having various band lengths.

Figure 2:
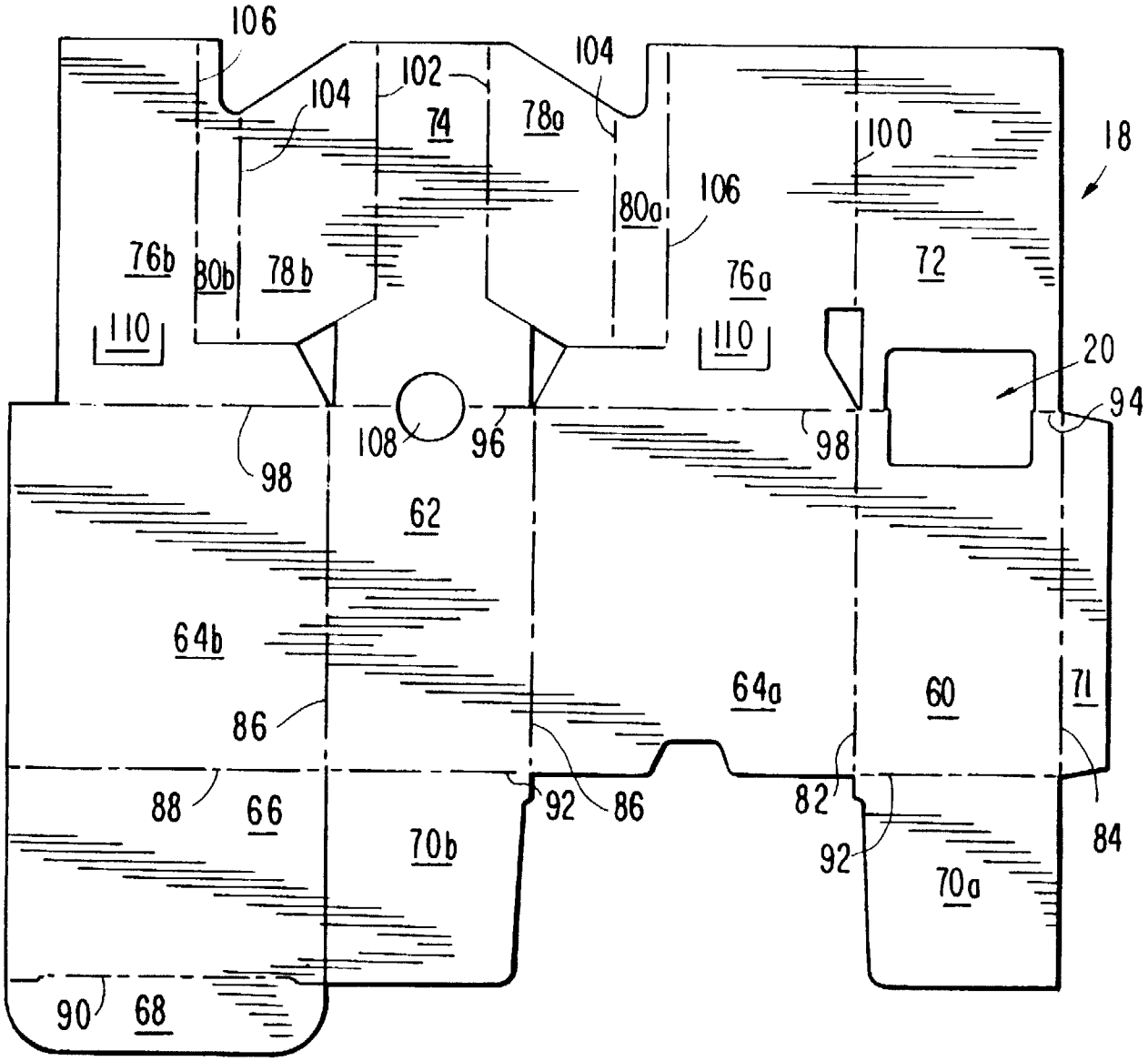
FIG. 2 is a plan view of an unfolded box constructed in accordance with the present invention.
Figure 6:
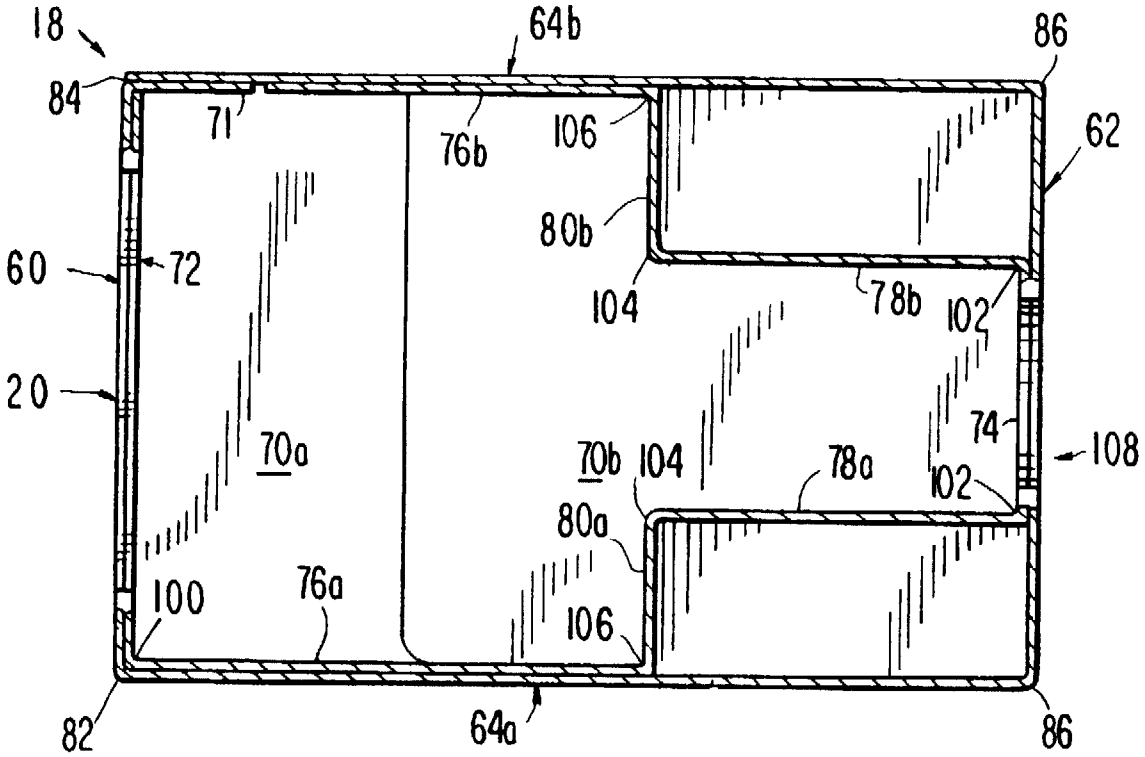
FIG. 6 is a bottom plan view of the box constructed in accordance with the invention in an assembled position.

Reference is now made to FIGS. 2 and 6 which depicts box 18, a box without a bottom and having a cut-out region 20 on a side for exposing face 16 of base 14 of stand 12. An unassembled box 18 includes a front wall 60, a rear wall 62, side walls 64a and 64b, and connecting wall 71. Front wall 60 is hingedly connected to side wall 64a by front wall hinge 82. Rear wall 62 is hingedly connected to each side wall 64a and 64b through rear wall hinges 86. Connecting member 71 is connected to front wall 60 via front wall hinge 84. Also included is a lid 66 hingedly connected to side wall 64*b* by lid hinge 88. Lid 66 is hingedly connected to a lid flap 68 by means of lid flap hinge 90. Box 18 includes two lid tabs 70*a* and 70*b*. A first lid tab 70*a* is connected to front wall 60 through lid hinge 92, while the other lid tab 70*b* is connected to rear wall 62 through a lid hinge 92.

The interior of box 18 is formed with an interior front wall 72, an interior rear wall 74, interior side walls 76*a* and 76*b*, guide walls 78*a* and 78*b* and end walls 80*a* and 80*b*. Interior front wall 72 is hingedly connected to front wall 60 through interior front hinge 94 about an opening 20. In addition, interior front wall 72 is hingedly connected to interior side wall 76*a* through interior hinge 100. Interior rear wall 74*a* is hingedly connected to rear wall 62 through interior rear wall hinge 96 about an opening 108. Interior rear wall 74 is further hingedly connected to guide walls 78*a* and 78*b* through guide wall hinges 102. Interior side walls 76*a* and 76*b* are hingedly connected to side walls 64*a* and 64*b*, respectively through interior side wall hinges 98.

Interior side walls 76*a* and 76*b* are further hingedly connected to end walls 80*a* and 80*b*, respectively through second end wall hinges 106. End walls 80*a* and 80*b* are also hingedly connected to guide walls 78*a* and 78*b*, respectively through first end wall hinges 104. Tab locks 110 are positioned on interior side walls 76*a* and 76*b*. Tab locks 110 are connected to interior side walls 76*a* and 76*b* on one end and are free on the other three sides. Tab locks 110 interact with locking tabs 34 on stand 12 as will be described below in greater detail.

Box 18 assembled is shown in FIG. 3, while the interior of box 18 is shown in FIG. 6. As shown, guide walls 78*a* and 78*b* and end walls 80*a* and 80*b* form two rectangular guide sections within box 18. The space between the guide sections is essentially the width of C-shaped cuff 17 of stand 12 so as to hold it in place when inserted therein. In addition, cut-out 20, best shown in FIG. 3, forms an opening so that face 16 of stand 12 is visible when inserted into box 18. Opening 108 forms a semicircle on rear wall 62 in the assembled position so that box 18 may be easily lifted from stand 12. Finally, connecting wall 71 is folded inwards to the interior of side wall 64 and is glued therein to hold box 18 in place. Glues or adhesives are used to adhere interior front wall 72 to front wall 60; interior rear wall 74 to rear wall 62; and interior side walls 76*a* and 76*b* to side walls 64*a* and 64*b*. However, tab locks 110, positioned on interior side walls 76*a* and 76*b*, are not glued to side walls 64*a* and 64*b*.

Reference is now made to sleeve 22 which is best shown in FIGS. 1 and 3. Sleeve 22 includes a top wall 112, a bottom wall 114, side walls 116 and a connecting wall 118. Connecting wall 118 is glued to the interior of one of side walls 116 to form a rectangular shaped box having two opened and opposed ends and an interior volume slightly greater than that of box 18. Sleeve 22 includes a cut-out 24 for disclosing bar code label 15 on the bottom of base 14 of stand 12.

To assemble watch package 10, a watch band of watch 13 is placed on C-shaped cuff 17 in any of the three manners discussed above depending on its size. Thereafter, manual 28 corresponding to the operation of watch 13 is inserted into opening 26 of base 14 of stand 12. Similarly, the corresponding tag 36 is inserted into tag receiving assembly 38. Thereafter, bar code label 15 is applied to the bottom of base 14 of stand 12 at bar code label receiving surface 15. The bar code also directly corresponds to the model, style and SKU number of watch 13. With stand 12 in its upright position and box 18 in an assembled condition, box 18 is placed on top of stand 12 so that the bottom of base 14 forms the bottom of assembled box 18.

Box 18 is then locked onto stand 12 by the interaction of locking tabs 34 on the sides of base 14 with tab locks 110 on interior side walls 76*a* and 76*b* of box 18. The interaction between these two parts forms an engaging lock so that the box may be held tight on stand 12. As described above, cut-out 20 displays face 16 of base 14. At this point in the process, typically no information is provided on face 16. Sleeve 22 is then inserted about box 18 so that cut-out 24 displays bar code label receiving surface 15 on stand 12. At the same time, face 16 of stand 12 is still visible through one of the open ends of sleeve 22. In this manner, the free ends of sleeve 22 are closed by front wall 60 and rear wall 62 of box 18.

At this stage, the watches are typically shipped to the different distributors and retailers. However, because the manufacturer only provides suggested retail prices, many of the distributors and retailers require separate placement of prices on the package. Therefore, when the watch package 10 is received, bar code label 15 is scanned through cut-out 24 and thereafter, an auto tagging machine may place a label on face 16 of stand 12. Alternatively, the label may be placed manually on face 16. Either way, the retailer or distributor may place a price tag on the package without the need to take apart box 18. Thereafter, once watch package 10 reaches the store, package 10 is easily taken apart by sliding off sleeve 22 and removing box 18. Display stand 12 is now properly priced, coded and ready for sale with the appropriate manual 28 and tag 36 already present. By providing such an arrangement, the amount of man power required to price, tag and label each specific watch is substantially reduced.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A display device for a wrist watch having a band and a watch face, said display device capable of being free standing on a support surface, comprising:

a base;

a connecting member extending from said base;

a generally U-shaped cuff member coupled to said connecting member, having an inner and outer circumference, the outer circumference of said cuff member being dimensioned to receive the band of the wrist watch extending thereabout with the watch face being generally positioned on the cuff member opposite the opening of the cuff member; and a generally U-shaped stopper having a first arm and a second arm, said first arm being coupled to said inner circumference of said cuff member and said second arm extending about the outer circumference of said cuff member and positioned below the intended position of the watch face to prevent movement of the said watch face along said outer circumference of said cuff member.

2. The display device of claim 1, wherein said cuff member is substantially flat in the region in which said watch face is positioned.

3. The display device of claim 1, wherein the cuff member has a width at least as wide as the width of the wrist watch.

4. A display device for a wrist watch having a band and a watch face, said display device being capable of being free standing on a support surface comprising:

a base, a connecting member extending from the said base;

a generally C-shaped cuff member, coupled to said connecting member, having an inner and outer circumference;

a guide member coupled to said cuff member near the opening of said cuff member, said guide member extending substantially away from the outer circumference of said cuff member, said outer circumference of said cuff member being dimensioned to receive the band of said wrist watch extending thereabout and about said guide member with the watch face being generally positioned on the cuff member opposite the opening of the cuff member, said guide member including an arm, a gap being formed between the outer circumference of the cuff member and said arm; and a cuff extendor coupled to said cuff member, said extendor being essentially positioned between the ends of said cuff member and being essentially U-shaped having a first arm and second arm, said first arm of said U-shaped member being coupled to said cuff member and the second arm being positioned within said opening of said cuff member along the path of said watch band.

* * * * *